United States Patent [19]

Vits

[11] Patent Number: 4,804,125

[45] Date of Patent: Feb. 14, 1989

[54] DEVICE FOR FLOATABLY GUIDING WEBS OF MATERIAL BY MEANS OF A GASEOUS OR LIQUID MEDIUM

[76] Inventor: Hilmar Vits, Hüchelrath 16, D-5653 Leichlingen, Fed. Rep. of Germany

[21] Appl. No.: 22,941

[22] Filed: Mar. 6, 1987

[30] Foreign Application Priority Data

Mar. 6, 1986 [DE] Fed. Rep. of Germany ..... 3607370

[51] Int. Cl.[4] ..... B65H 20/14; F26B 13/20

[52] U.S. Cl. ..... 226/97; 34/156

[58] Field of Search ..... 226/97; 34/156, 160

[56] References Cited

U.S. PATENT DOCUMENTS

| | | | |
|---|---|---|---|
| 2,144,919 | 1/1939 | Gautreau | 34/48 |
| 3,181,250 | 5/1965 | Vits | 34/23 |
| 3,272,415 | 9/1966 | Wallin | 226/97 |
| 3,281,957 | 11/1966 | Ranney et al. | 34/156 |
| 3,559,301 | 2/1971 | Fraser | 34/156 |
| 3,618,226 | 11/1971 | Goldenberg et al. | 34/156 |
| 3,837,551 | 9/1974 | Schregenberger | 226/97 |
| 3,957,187 | 5/1976 | Puigrodon | 226/97 X |
| 4,058,244 | 11/1977 | Vits | 226/97 |
| 4,069,595 | 1/1978 | Ahlbert et al. | 34/156 |
| 4,290,210 | 9/1981 | Johansson | 226/97 X |
| 4,384,666 | 5/1983 | Koponen et al. | 226/97 |

FOREIGN PATENT DOCUMENTS

| | | |
|---|---|---|
| 1474239 | 2/1972 | Fed. Rep. of Germany . |
| 3318861 | 11/1984 | Fed. Rep. of Germany . |
| 2547803 | 5/1984 | France . |
| 2141989 | 12/1986 | United Kingdom . |

*Primary Examiner*—Daniel P. Stodola
*Assistant Examiner*—Lynn M. Sohacki
*Attorney, Agent, or Firm*—William J. Crosetta; Michael L. Dunn

[57] ABSTRACT

This invention relates to a device for floatably guiding webs of material by means of gaseous or liquid medium. The device comprises at least one elongate flow member having a surface convexly curved on the top side proximate the web, and nozzles which are disposed in rows along longitudinal edges and via which the gaseous or liquid medium can be introduced in jets between the flow member and the web of material. The nozzles associated with one longitudinal edge of the device are offset in pitch in relationship with the other longitudinal edge and are so disposed that opposing diverging flow jets, flow past one another without mutual impedance. The apparatus operates on both the supporting airfoil and air cushion principles, with a smooth transition from one principle to another.

10 Claims, 3 Drawing Sheets

Figure 1:
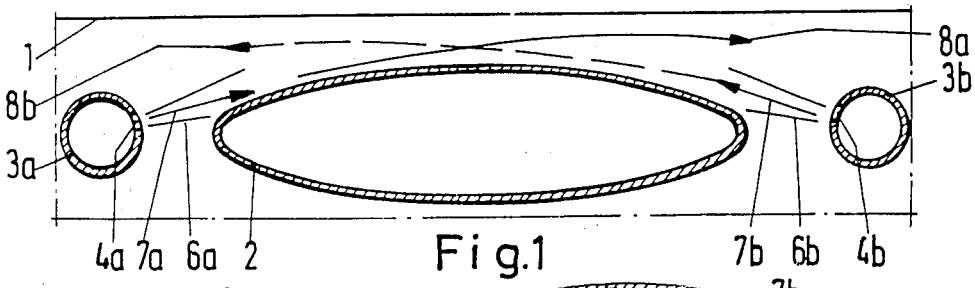

DEVICE FOR FLOATABLY GUIDING WEBS OF MATERIAL BY MEANS OF A GASEOUS OR LIQUID MEDIUM

The invention relates to a device for floatably guiding webs of material, comprising an elongate flow member disposed at right angles to the moving direction of the web and having a surface convexly curved on the top side of the web, and nozzles which are disposed in rows on both longitudinal edges and via which the gaseous or liquid medium can be introduced in jets between the flow member and the web of material, the nozzles associated with one longitudinal edge of the flow member being offset by about half the pitch (distance between adjacent nozzles) in the direction of the longitudinal axis of the flow member in relation to the nozzles associated with the other longitudinal edge.

In devices for floatably guiding webs of material by blown air a distinction is drawn between those operating by the airfoil principle and those operating by the air cushion principle. In a device operating by the airfoil principle the blown air emerges directly as a wall jet from a slot formed in a longitudinal edge of the flow member or from holes disposed in rows, and plays on the convexly curved surface of the flow member. The web of material passing though is subjected alternately to compressive and suctional forces. The floatable guiding of such devices is not optimum, even with further arrangements, such as holes in the airfoil to suck in additional air.

A device operating on the air cushion principle differs from an apparatus operating on the airfoil principle by the feature that blown jets are directed towards one another from the two opposite longitudinal edges of the flow member. The jets can emerge from slots or from holes disposed in rows. In either case the jets impinge on one another and become dammed between the web of material and the curved surface, thus forming an air cushion supporting the web. Even with such a device the supporting behavior is not optimum, since it decreases only very gradually as the distance of the web from the curved surface decreases.

The category of devices operating on the air cushion principle also includes a known device of the kind specified (U.S. Pat. No. 3,957,187) in which rectangular blown air outlets are disposed in rows on each longitudinal edge in the curved surface of the flow member. With a guide tongue disposed in each blown air outlet the air is so guided that it immediately plays in the form of a shallow, wide wall jet over the curved surface. Since the length of the blown air outlets of each rows is substantially equal to their mutual distance, the mutual offsetting of the opposite blown air outlets of the two rows ensure that the diverging blown air jets impinge on one another, and an air cushion forms between the two rows. The formation of the air cushion is further boosted by the feature that blown jets emerging from smaller outlets between the two rows disturb the blown air jets from the larger outlets.

Finally, it is known to play on a web of material with free jets directly—i.e., without the aid of a flow member. However, this manner of floatably guiding webs of material has not become established in practice, in comparision with the devices operating on the airfoil and air cushion principle.

It is an object of the invention to provide a device for floatably guiding webs of material which uses the advantages of the devices operating on the airfoil and air cushion principles, but is free from their disadvantages. The device therefore has an attracting effect with large distances between the web and the surface of the flow member, and a repelling effect when such distances are small.

This problem is solved according to the invention in a device of the kind specified by the features that the nozzles are constructed as free jet nozzles which are disposed at a distance from the flow member and are so directed at an acute angle to the web shallowly into the gap between the web and the surface of the flow members that the adjacent edge regions of the diverging flow jets escaping from opposite nozzles flow past one another substantially without mutual impedance in the absence of a web of material and impinge on one another more and more as the distance of the web of material from the surface of the flow member decreases.

It is true that in the device disclosed in U.S. patent application Ser. No. 022,778 filed on Mar. 6, 1986 have with nozzles associated with both edges of the flow member, but not offset in relation to another, a substantially improved supporting behavior is already obtained due to the same approach flow principle with free jets, but it takes place at a substantially lower supporting force level and with a less steep characteristic than in the device according to the present invention. This improvement is due to the feature that the special arrangement of the nozzles in relation to one another and to the surface of the flow member enables the flow jets to flow unimpeded from one edge of the flow member over the surface to the other edge, as long as the web of material is at a large distance from the surface. With these flow conditions a small negative pressure forms between the surface of the flow member and the web of material, on which it exerts an attracting action. This action, typical of devices operating on the airfoil principle, is progressively lost and replaced by the action of a cushion rapidly becoming stronger when the web approaches the surface of the flow member. This transition between a device operating on the airfoil principle and one operating on the air cushion principle is due to the fact that the flow jets emerging divergently from the nozzles are pressed flat as the distance of the web from the surface of the flow member decreases, and this results in an increase in the angle of divergence. In that case the edge jets can no longer flow unimpeded past one another, but impinge on one another, so that the flow medium is dammed between the two rows of nozzles. When the force acting on the web of material is plotted mn a graph over the distance of the web from the flow member, the improved supporting force behavior of the device according to the invention can be demonstrated by the fact that the supporting force is very great with a very close distance of the web, and the characteristic of the supporting force reaches zero value with great steepness.

The special geometrical association of the nozzles with one another and in relation to the surface of the flow member creates well-defined flow conditions for the flow medium. Both during the operation of the device on the airfoil principle and also during the transition to its operation on the air cushion principle, the flow medium flowing without disturbance over the flow member, or the flow medium forced to reverse by the impingement of the flow jets can flow away between the flow jets transversely of the longitudinal axis of the flow member via one or other of the longitudinal edges. Since the flow jets passing over the flow member are present also in the zone of the edges of the material, they prevent the medium from flowing away transversely of the edges of the web from the cushion formed between the web and the flow member. This flow behavior precludes any flapping of the edges of the web, such as easily occurs in conventional devices operating on the air cushion principle due to a disturbance in the longitudinal axis of the flow member. Even with a large distance between the web edge and the flow member, during operation with heated blowing air the feature that the flow member is flowed over improves heat transfer between the flow medium and the web, combined with a uniformly distributed heating of the web, in comparision with conventional devices operating on the air cushion principle, since when a large area is flowed over, the flow conditions are uniform over the length of the flow member.

With the device according to the invention the volume and pressure can be to a very great extent adapted to the various problems of floatably guiding and if necessary thermally treating webs of material.

Due to the advantage of the device according to the invention of changing from the behavior of an air cushion device to the behavior of an airfoil device it may be operated with a great volume of medium as common devices for floatable guiding having a nozzle cross-section of 2% related to the surface of the web of material acted upon or with a small volume wherein the nozzle cross-section is 2 o/oo. As far as treating the web with heat is not required but only guiding the web the nozzle cross-section may be reduced to 0.1 o/oo. The invention allows such a great reduction of the cross-section combined with a greater pressure without a negative influence on the guiding properties, and therefore a smaller air volume which is advantageous because no longer large capacity of conventional driers is required.

While with circulating air driers the blown air emerging from the nozzles is required not only to floatably guide the web, but also to dry the web and absorb the substances volatilized during drying, in a device of the kind according to the invention the functions of floatably guiding and drying can be separated. In that case the device according to the invention is used exclusively for floatable guiding, while drying is performed by additional elements, for example, infrared radiators which are disposed between the individual devices. The infrared radiators can be constructed as bright or obscure radiators. The flow members can be used as obscure radiators, in which case they take the form of hollow members through which a heating medium flows.

Due to the small volume of blown jets emerging at high flow velocity from the nozzles the device according to the invention can also be used in a drier as a barier sluice at the inlet slot for the web of material. In that case the device is operated with highly heated blown air. By mixing it with the cold air flowing in via the inlet slot, the blown air is heated to a temperature at which mixing with the solvent-containing drier atmosphere can no longer cause harmful condensations.

The devices according to the invention can be operated not only with blown air, but also with a liquid medium. One application is for pickling baths for metal ribbons. In such a case the use of the device according to the invention achieves an appreciable saving in the volume of the bath, since the intensity of the jets of liquid improves the pickling action when high pressure pumps are used. The use of high pressure pumps also creates the precondition for small pipes leading to the nozzles. This results in an appreciable reduction in the costs of construction. The flow members can be constructed in the form of ducts and guide the heating medium to heat the bath uniformly. With a centrally heated pickling bath the mordant can be introduced into the flow members and supplied to the nozzles in their walls. This obviates surface faults in thin nd sensitive ribbons, which are otherwise caused by faults in the roller surface.

According to a first feature of the invention the axis of the flow jets of each nozzle forms a secant, tangent or passant to the curved surface of the flow member. It is important under high pressure and small volume conditions, that taking into account the angle of divergence of the associated flow jet and the distance of the nozzle from the surface of the flow member the flow jet flows by about one third of its periphery onto the surface of the flow member in the absence of the web of material. Because of the Bernoulli-effect the flow members and the web of material act in combination on the flow jets. In circulating air driers treating insensitive webs the flow jets may be directed onto the web to greater extent for improving the heat transition. Instead of the Coanda-effect the web of material diverts and guides the blow jets onto the flow member where the blow jets become wall jets. The distance of the nozzles from the flowed-on surface of the flow member amounts to a least 1/10 of the path travelled by the flow jet on the surface of the flow member. Any mutual impedance of adjacent flow jets is in any case reliably precluded by another feature of the invention, namely that the connecting lines between the facing edges of the opposite jets, projected to a central plane of web guiding, each enclose an angle between 5° and 20°, more particularly between 10° and 12°.

The convexly curved surface of the flow member can have different shapes. The shape of a shallow arc of an ellipse, a shallow compound curve or a shallow polygon have been found convenient. Optimum results can be achieved with arcs of an ellipse with the axial ratio 1:4 for high pressure blown air (above 50 mbar) and 1:3 for recirculated air pressure (under 30 mbar).

With a number of flow members disposed in rows in the direction of travel of webs, conveniently a common supply duct for the flow medium for the nozzles associated with the two flow members is provided between the two adjacent flow bodies, or the flow bodies are constructed in the form of supply duct bearing the nozzles which are associated wit the adjacent flow members.

With a number of flow members disposed one after another in flow direction the distance of the successing arcs of an ellipse should be preferably 50–80% of the main axis of the ellipse, if channels for the medium are disposed between the flow members, but only about 10% if the flow members themselves are constructed as channels for the medium for example for the circulating air.

To fix the discharge conditions, according to a further feature of the invention a discharge duct is provided between the nozzles and the flow member on the side remote from the web of material.

The discharge duct can discharge into a collecting duct, which is formed by a flow member.

Figure 2:
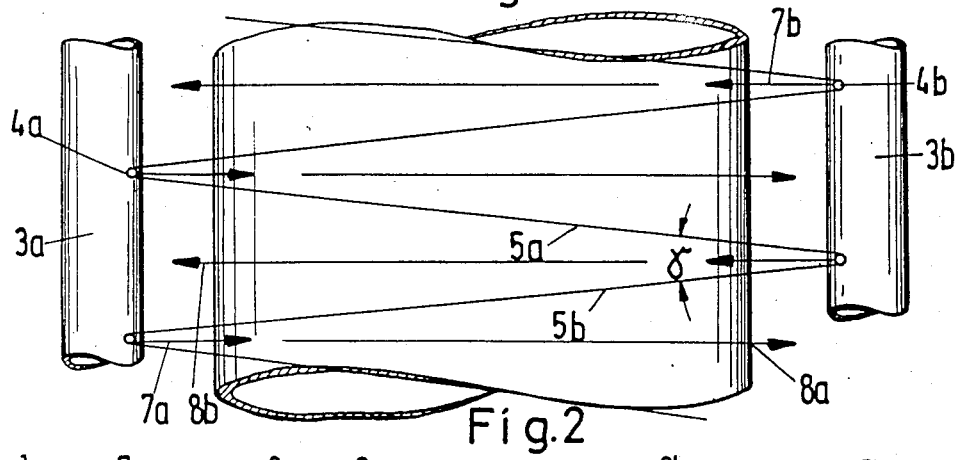
Figure 3:
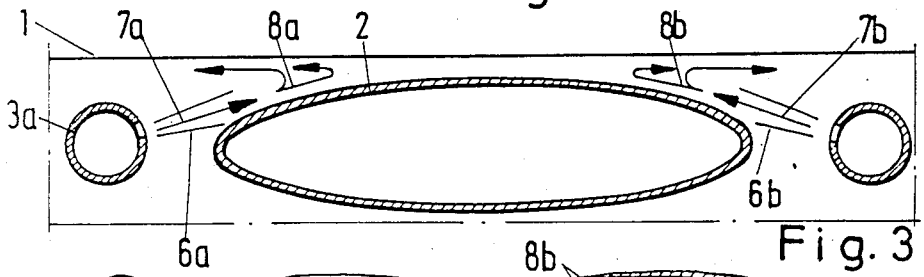
Figure 4:
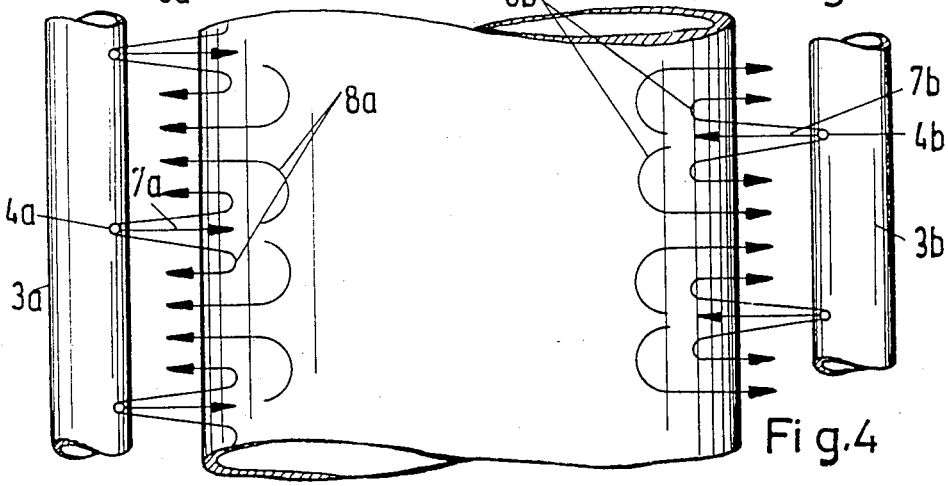
Figure 5:
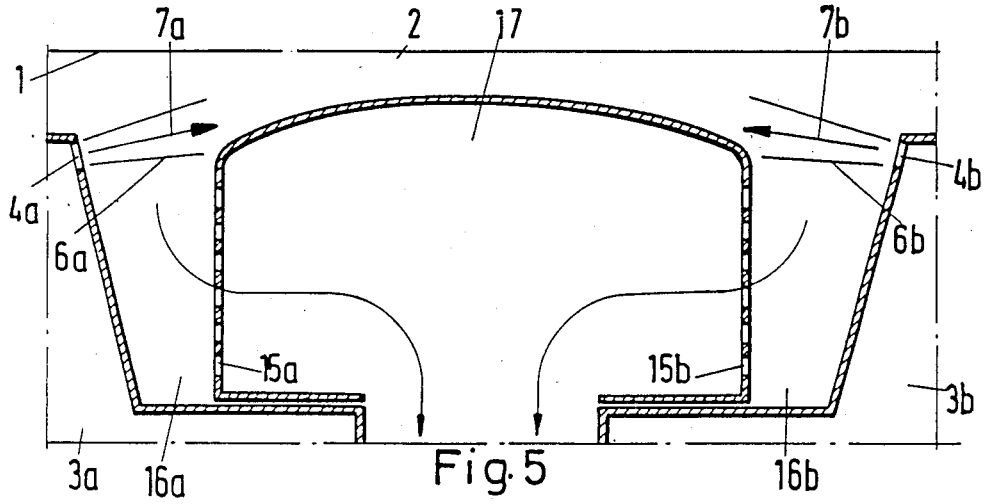
Figure 6:
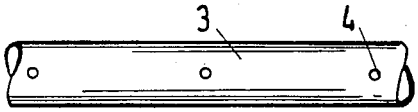
Figure 7:
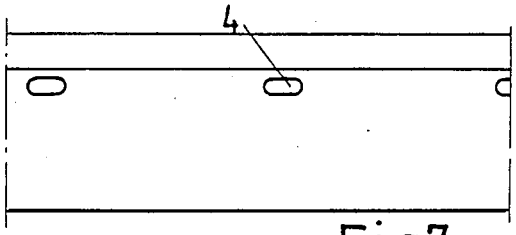
Figure 8:
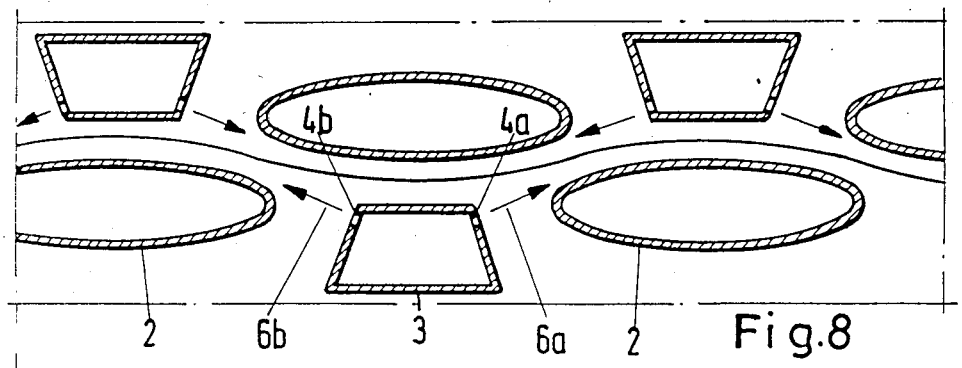
Figure 9:
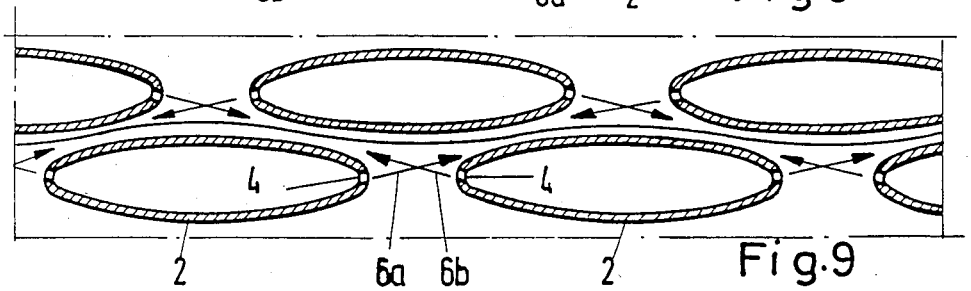
Figure 10:
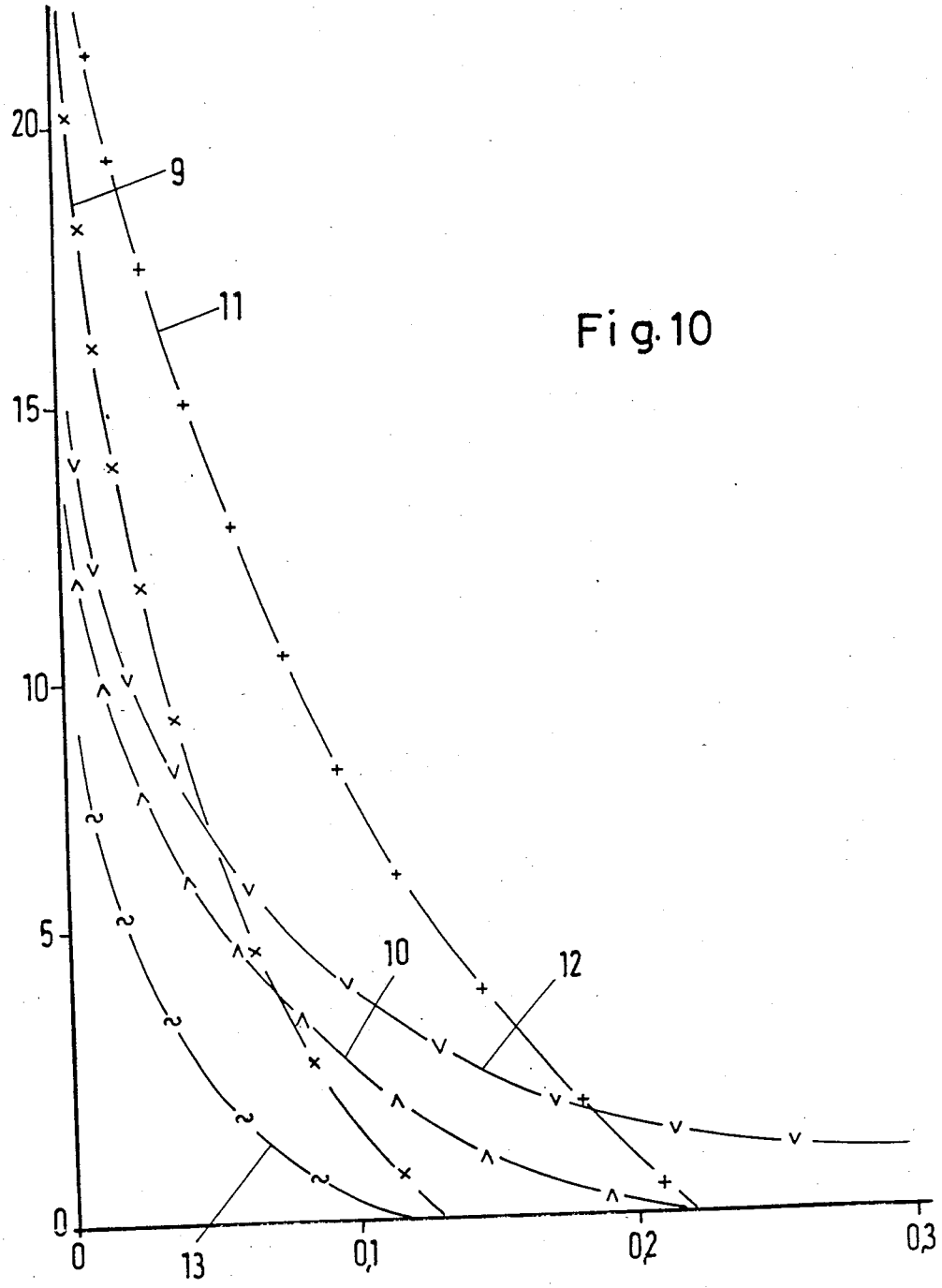

The invention will now be described in detail with reference to the drawings, wherein:

FIG. 1 shows in cross-section in the direction of travel of the web a device for floatably guiding webs of material with a large web distance, FIG. 2 is a plan view of the device shown in FIG. 1, FIG. 3 shows in cross-section in the direction of travel of the web the device illustrated in FIG. 1 with a small web distance, FIG. 4 is a plan view of the device shown in FIG. 3, FIG. 5 shows in cross-section in the direction of travel of the web another device for floatably guiding webs of material, FIG. 6 is an elevation of a nozzle tube having circular nozzles of small cross-section FIG. 7 is a plan view of a blowing box having elongate nozzles of large cross-section, FIG. 8 shows in cross-section in the direction of travel of the web a detail of a number of devices disposed above and below a web of material for floatably guiding the web, FIG. 9 shows in cross-section in the direction of travel of the web a detail of a number of devices disposed above and below a web of material for floatably guiding webs, and FIG. 10 is a graph of the supporting force behavior of different devices for floatably guiding webs of material.

The device shown in FIGS. 1 to 4 for slidably guiding a web of material 1 comprises a flow member 2, having in cross-section the shape of a shallow ellipse, and nozzle tubes 3a,3b which are disposed on both longitudinal edges of the flow member 2 and via which blown air can be supplied to nozzles 4a,4b, of small cross-section. The nozzles 4a,4b are formed in the tube 3a,3b and arranged in rows at equal mutual distances, as shown in FIG. 6 or 7. Their distance from the flow members 2 amounts to about 1/10 of the path of travel of the flow over the flow member 2, which is somewhat larger than the width of the flow member 2 because of its curvature. The nozzles 4a,4b, of the two rows are offset in relation to one another by half a pitch (distance between two adjacent nozzles 4a,4b) in the direction of the longitudinal axis of the flow member 2. The mutual distance of the nozzles 4a,4b and the distance of the opposite rows of nozzles is so selected that the connecting lines 5a,5b, projected through a central plane of web guiding, enclose between the facing edges of the opposite nozzles an angle $\gamma$ of 5° to 20°. The free jets 6a,6b emerging from the nozzles 4a,4b flow shallowly onto the curved surface of the flow member 2. The central flow axis 7a,7b forms either a secant, a tangent or a passant, as shown in the embodiment illustrated. The free jets 6a,6b should flow by at least one third of its periphery(peripheral flow) onto the surface of the flow member 2.

As FIGS. 1 and 2 show for a large distance of the web of material 1 from the surface of the flow member 2, the blown air jets emerging as free jets from the nozzles 4a,4b, after impinging on the flow member 2 become, due to the Coanda-effect, operative wall jets 8a,8b which flow unimpeded over the curved surface of the flow member 2, since the diverging wall jets remain within the particular field of flow bounded by the angle $\gamma$. This means that the blown air jets flowing in the opposite direction of the surface do not interfere with one another even by their edge jets.

Since the web of material 1 has a large distance from the curved surface of the flow member 2, the blown air jets are not narrowed in height. The jets flowing at high flow velocity over the curved surface exert an attracting effect on the web of material 1. Consequently the flow channel between the curved surface and the web of material becomes narrower. The diverging jets are therefore pressed flat by the web 1 because of the Bernoulli-effect. As a result, however, their angle of divergence becomes larger and the opposite blown jets impinge more and more on one another and blown air becomes dammed on the surface of the flow member between its longitudinal edges, as shown in FIGS. 3 and 4. The device operating on the airfoil principle has therefore become a device operating on the air cushion principle. The excess pressure in the air cushion ensures a reversal of flow. The blown air then flows away via the longitudinal edges in each case between the adjacent jets of the same row of nozzles, transversely of the longitudinal axis of the flow member 2.

When the device according to the invention is operated, the web of material 1 moves to a distance from the flow member 2 to the stable position such that the weight and counterpressure of the web 1 is compensated by the supporting force of the device. Thin and light webs require practically no air cushion and can therefore be guided without any undulating line. This enables flow members also to be disposed opposite on both sides of the web.

In FIG. 10 characteristic curves for the supporting force are plotted over the distance of the web from the surface of the flow member for different devices for slidably guiding webs of material. To obtain a true comparision of the various devices, dimensionless distance values have been selected for the abscissa and dimensionless supporting force values for the ordinate. The dimensionless distance is the ratio between the absolute distance and the extension of the flow member in the direction of travel of the web. The dimensionless supporting force is the ratio between the absolute supporting force and the product of the initial dynamic pressure and the cross-section of the nozzles, taking contraction into account.

Curve 13 represents the supporting force behavior of a traditional device operating on the supporting surface principle for floatably guiding webs of material, while curve 12 represents the supporting force behavior of a device operating on the air cushion principle for floatably guiding webs.

A disadvantage of the first-mentioned device is that the supporting force is not particularly great even with a very small distance. There is therefore a risk that the web will contact the flow member. It is true that in such a device the required supporting force zero value is reached, but in that case with little steepness of curve and only by totalizing successive zones of excess and negative pressure. This means that with such devices there is a tendency for the edges of the web to flap.

It is true that with the second-mentioned device for floatably guiding webs of material a substantially higher supporting force is obtained with a small web distance than with the first-mentioned device, but the curve has less steepness and the supporting force zero value is not reached. This means unstable guiding and the flapping of the web edges.

Curve 10 shows the supporting behavior of a device with free jets, according to a patent of the same priority date, which differs from the device according to the invention only by the feature that the opposite nozzles associated with the same flow member are not offset from one another by half a pitch. With this device the supporting force reaches the zero value, as in the case of the first-mentioned device, but as a whole it lies at a higher level. This means that this device has a better supporting force behavior than the two known devices.

In comparison with the supporting behavior of these known devices, but also with that of the other patent, the device according to the invention is distinguished by a superior supporting behavior. The curve 9 represents the supporting force behavior of the device according to the embodiment illustrated in FIGS. 1 to 4 having nozzles of small cross-section according to FIG. 6. With a small web distance the supporting force of the device according to the invention is substantially greater than that of the devices operating on the air cushion principle. Due to the greater steepness of the curve, the floatable guiding is substantially more stable when supporting force zero value is reached. The device according to the invention therefore enables webs of material to float free from undulation and flapping, independently of the tensile stessing in the longitudinal direction of the web.

The supporting behavior of the device changes if the cross-section of the nozzles is increased. The curve 11 shows the supporting behavior of device according to FIG. 5 with nozzles according to FIG. 7 operated with a great volume of air as in air circulating driers. The course of the curve 11 corresponds principally to the course of curve 9 but with a greater web distance. Still the supporting behavior of this device is better than the behavior of common devices, because of the greater supporting force at small distance and the decrease of this force to zero. The web distance corresponds to the web distance of common devices.

While in the embodiment illustrated in FIGS. 1 to 4 the flow member 2 can take the form of a tube through which a heating or cooling medium flows, to heat the blown air emerging from the nozzles, such heating is unnecessary in the embodiment illustrated in FIG. 5, which can be operated with recirculated air. In the embodiment illustrated in FIG. 5 the surface of the flow member 2 adjacent the web of material 1 has substantially the same shape as the flow member 2 of shallow elliptical cross-section of the embodiment illustrated in FIGS. 1 to 4. Instead of the nozzles 4 of round, relatively small cross-section formed in a tube 3, jets 4 of oval, substantially larger cross-section are formed in boxes 3 for the supply of blown air, as shown in FIG. 7. While the nozzles 4 of small cross-section according to FIG. 6 are operated with a small volume of air, but at a higher pressure, the nozzles 4 of large cross-section according to FIG. 7 are operated with a large volume of air, but at a low pressure. The latter nozzles are suitable for use in a recirculating air drier, while the first-mentioned nozzles are suitable for use for floatably guiding webs of material, more particularly when the heat transfer by the air is of secondary value.

The flow member 2 in the embodiment illustrated in FIG. 5 takes the form of a box-shaped duct whose side walls have a grid 15*a*,15*b* via which the used blown air flowing in between the free jets 6*a*,6*b* can be discharged.

Such a device operates on the same principle as that illustrated in FIGS. 1 to 4. As already stated, the only difference is that the jets 4 shown in FIG. 7 have different, larger cross-section. Curve 11 in FIG. 10 shows the supporting behavior of a device as illustrated in FIG. 5. Substantially the same statements can therefore be made about this device as about the device with the supporting behavior by curve 9. The embodiments illustrated in FIGS. 8 and 9 show possible arrangements of devices for floatably guiding webs of material above and below the web. The device shown in FIG. 8 is built up from devices shown in the embodiment illustrated in FIG. 5, while the device illustrated in FIG. 9 is formed of shallowly elleptical hollow members form the flow members and at the same time supply ducts for blown air to the nozzles formed on their longitudinal edges. In this embodiment the nozzles are so arranged that the free jets intersect one another in the longitudinal axis of the flow members as shown in the projection, but not in reality.

The arrangement of the devices according to the invention as shown in the embodiment illustrated in FIG. 8 is particularly suitable for air and liquid calenders. Due to the hard cushion on the flow members, the narrow arrangement and the convex shape of the flow members, it is possible to dispose the flow members and the trapezoidal air and liquid ducts 3 on both sides of the web of material at a zero distance to the central plane lying therebetween, or moreover even intermeshing with one another to some extent by toothing, so that the web of material is guided in short waves with large amplitudes. As a result bulges and longitudinal folds due to uneven moisture, the structure of the material or expansion are obviated as early as the drying process, so that often subsequent calendering for smoothing can be dispensed with.

In the embodiment illustrated in FIG. 9 the flow members are moved even closer together and at the same time form the supply ducts for the blown air to the nozzles 4,4. This arrangement is more particularly suitable for operating with compressed air, high-pressure steam or pressurized liquids. This embodiment is not restricted to a special application. If it is used for circulating air driers (great air volume) the required volume of the members can be provided on the back side of the members. Due to the narrow distribution of the nozzles and therefore of the flow jets a great technical progress is achieved in the supporting behavior and the heat transfer in relation to circulating driers having common devices.

I claim:

1. A device for floatably guiding webs of material, comprising an elongate flow member, disposed at right angles to the moving direction of the web and having a surface convexly curved on the web side, and nozzles which are disposed in rows on longitudinal edges of the flow member and via which a gaseous or liquid medium can be introduced in jets between the flow member and the web of material, the nozzles associated with one longitudinal edge of the flow member being offset, by about half the pitch in the direction of the longitudinal axis of the flow member in relation to the nozzles associated with the other longitudinal edge, characterized in that the nozzles are constructed as free jet nozzles which are disposed at a distance from the flow member and are so directed at an acute angle to the web shallowly into the gap between the web and the surface of the flow members that the adjacent edge regions of the diverging flow jets escaping from opposite nozzles flow past one another substantially without mutual impedance in the absence of a web of material an impinge on one another more and more as the distance of the web of material from the surface of the flow member decreases.

2. A device according to claim 1, characterized in that each of the flow jets has a central axis which forms a secant, tangent or passant to the curved surface of the flow member, and the distance of the nozzles from the surface of the flow member is such, taking into account the angle of divergence of the associated flow jet, that the flow from along at least one third of the jets periphery flows onto the surface of the flow member in the absence of the web of material.

3. A device according to claim 1, characterized in that the distance of the nozzles from the flowed-on surface of the flow member amounts to from about 1/10 to about 1/5 of the distance followed by the flow jet on the surface of the flow member disposed opposite to the web.

4. A device according to claim 1, characterized in that the connecting lines between the facing edges of the opposite jets, projected to a central plane of web guiding, each enclose an angle between about 5° and about 20°.

5. A device according to claim 1 characterized by including at least one flow member having a cross-section the shape of a shallow ellipse or a shallow polygon with a convexly or compound curved surface.

6. A device according to claim 1 characterized in that with a number of flow members disposed in rows in the direction of travel of the web, a common supply duct for the gaseous or liquid medium for the nozzles associated with the two flow members is disposed between two adjacent flow members.

7. A device according to claim 1, characterized in that with a number of flow members disposed in rows in the direction of travel of the web, the flow members are constructed as supply ducts for the gaseous or liquid medium, and their walls contain the nozzles which are associated with the adjacent flow members.

8. A device according to claim 1, characterized in that a discharge duct is provided between the nozzles and the flow member on the side remote from the web of material.

9. A device according to claim 8, characterized in that the discharge duct discharges into a collecting duct which is formed by the flow member.

10. A device according to claim 1, characterized in that connecting lines between the facing edges of the opposite jets, projected to a central plane of web guiding each enclose an angle between about 10° and about 12°.

* * * * *

UNITED STATES PATENT AND TRADEMARK OFFICE

CERTIFICATE OF CORRECTION

PATENT NO. : 4,804,125

DATED : February 14, 1989

INVENTOR(S) : Hilmar Vits

It is certified that error appears in the above-identified patent and that said Letters Patent is hereby corrected as shown below:

Column 8, Claim 1, line 63, after "material" delete "an" and insert ---and---.

Signed and Sealed this

First Day of August, 1989

*Attest:*

*Attesting Officer*

DONALD J. QUIGG

*Commissioner of Patents and Trademarks*